US006106369A

United States Patent [19]

Konishi et al.

[11] Patent Number: 6,106,369

[45] Date of Patent: Aug. 22, 2000

[54] POLISHING SYSTEM

[75] Inventors: Nobuo Konishi, Nakakoma-gun; Mitsuaki Iwashita, Nirasaki, both of Japan

[73] Assignee: Tokyo Electron Limited, Tokyo-To, Japan

[21] Appl. No.: 09/186,885

[22] Filed: Nov. 6, 1998

[30] Foreign Application Priority Data

Nov. 11, 1997 [JP] Japan ..... 9-325392

[51] Int. Cl.[7] ..... B24B 1/00

[52] U.S. Cl. ..... 451/41; 451/11; 451/66; 451/287; 451/288

[58] Field of Search ..... 451/11, 41, 285–290, 451/65, 66, 57

[56] References Cited

U.S. PATENT DOCUMENTS

| | | | |
|---|---|---|---|
| 4,481,738 | 11/1984 | Tabuchi | 451/285 |
| 4,771,578 | 9/1988 | Jorgensen et al. | 451/11 |
| 5,299,389 | 4/1994 | Yohana et al. | 451/11 |
| 5,674,115 | 10/1997 | Yamashita et al. | 451/289 |
| 5,725,414 | 3/1998 | Moinpour et al. | 451/41 |
| 5,827,111 | 10/1998 | Ball | 451/11 |
| 5,944,582 | 8/1999 | Talieh | 451/287 |

FOREIGN PATENT DOCUMENTS

| | | |
|---|---|---|
| 57-59337 | 4/1982 | Japan . |
| 57-102024 | 6/1982 | Japan . |
| 63-127534 | 5/1988 | Japan . |
| 3-286529 | 12/1991 | Japan . |
| 5-129261 | 5/1993 | Japan . |
| 6-216095 | 8/1994 | Japan . |
| 7-288244 | 10/1995 | Japan . |
| 8-19960 | 1/1996 | Japan . |
| 9-148295 | 6/1997 | Japan . |

*Primary Examiner*—David A. Scherbel
*Assistant Examiner*—G. Nguyen
*Attorney, Agent, or Firm*—Smith, Gambrell & Russell, LLP; Beveridge, Gambrell & Russell, L.L.P.

[57] ABSTRACT

A polishing system comprises: a rotating mounting table 14 which is rotatable while holding an object W to be polished; a rotating polishing plate 28 which has a smaller diameter than that of the rotating mounting table and which is provided with an abrasive layer 30 on the surface thereof; a scanning mechanism 26 for moving the rotating polishing plate in radial directions of the rotating mounting table while pressing the abrasive layer on the object; and abrasive solution supply means 46 for supplying an abrasive solution to the surface of the object. Thus, the system can be decreased in size, and the polished quantity can be partially controlled.

19 Claims, 4 Drawing Sheets

POLISHING SYSTEM

BACKGROUND OF THE INVENTION

1. Field of the Invention

The present invention relates generally to a polishing system and method for polishing the surface of an object to be polished, such as a semiconductor wafer.

2. Related Background Art

In general, a process for producing a semiconductor device includes a polishing process called CMP (Chemical Mechanical Polishing) for carrying out the planarization of irregularities on a thin film deposited on the surface of a semiconductor wafer. For example, in this polishing process, an abrasive solution including mechanical abrasive particles and chemical abrasive particles is added dropwise to the surface of an abrasive cloth, which is pressed on the surface of the wafer to be caused to rotate on its axis or revolve around the axis of the wafer to chip a part of the surface of the wafer to carry out the planarization of the wafer. Such a polishing process is used for carrying out planarization treatments for various metal films, such as an etch back treatment for an $SiO_2$ interlayer insulator film in a step of forming the wiring in respective layers, a planarization treatment for a hole embedded plug metal film, or a planarization treatment for a Cu metal damascene metal film.

A conventional polishing system for carrying out a CMP polishing process will be described below. For example, in a CMP system shown in FIG. 8, a wafer W held on a wafer holding mechanism 6 to be laid face down is pressed on a large rotating table 4, on which an abrasive cloth 2 serving as an abrasive layer is formed. Then, while an abrasive solution is supplied from a nozzle 8 to the surface of the abrasive cloth 2, the rotating table 4 is rotated, and the wafer holding mechanism 6 is rotated by means of a motor 10. Thus, the semiconductor wafer W is caused to rotate on its axis and revolve around the axis of the rotating table 4 to polish the surface of the wafer W to carry out the planarization of the surface.

The abrasive cloth 2 is made of, e.g., a foam resin, such as urethane foam resin, which has a thickness of, e.g., about 1.2 mm. The abrasive solution is a slurry including silica ($SiO_2$) serving as mechanical polishing particles and chemical polishing particles which are dispersed in a solution. In such a CMP polishing process, the mechanical polishing particles get in recesses formed in the surface of the foam resin, to obtain mechanical polishing action by friction due to the mechanical polishing particles captured by the recesses. This mechanical polishing action is associated with chemical polishing action to more efficiently carry out the polishing.

In the above described conventional system, the diameter of the rotating table 4 is twice or more as large as that of the wafer W, and the whole surface of the wafer W faces a part of the whole surface of the abrasive cloth 2 mounted on the rotating table 4.

In the above described conventional system, the diameter of the rotating table 4 must be very large since the whole surface of the wafer W is pressed on the abrasive cloth 2. Therefore, there is a problem in that the space occupied by the rotating table 4 is very large. In particular, in the present circumstances where the wafer size is further increasing from 6 inches to 8 inches and 12 inches (about 30 cm), the diameter of the rotating table 4 is about 60 cm when the wafer size is 12 inches. Therefore, it is desired to decrease the size of the rotating table 4.

Also in this conventional system, the whole polished surface of the wafer is always pressed to the abrasive cloth 2. Therefore, even if a part of the wafer is intended to be polished in accordance with the warp, distortion or the like of the wafer itself, it is not possible to carry out such polishing, and it is difficult to finely and partially control the polished quantity, so that it is difficult to accurately improve the flatness in plane.

Moreover, the abrasive solution added dropwise to the abrasive cloth 2 is easily accumulated on the periphery of the rotating table 4 by centrifugal force. For that reason, there is a problem in that the polishing conditions at the periphery of the wafer W are different from those at the central portion thereof so that the periphery of the wafer W, in which a greater quantity of abrasive solution is accumulated, is early polished and the central portion in the plane of the wafer, in which the abrasive solution is difficult to penetrate, is late polished. In addition, there are some cases where the processed locus of the rotating table is applied to the surface of the wafer.

Since the abrasive solution must be supplied to the whole of the abrasive cloth 2 having a great area, the quantity of the abrasive solution to be used is great. In addition, a plurality of polishing processes, such as rough machining and finish machining, are typically carried out by changing the kind of abrasive solutions. If the finish machining is intended to be carried out by means of the same system after the rough machining, the abrasive solution for rough machining, which penetrates in the abrasive cloth 2, must be sufficiently washed away. Therefore, it takes a lot of time to clean the abrasive solution to decrease throughput since the area of the abrasive cloth 2 is great as described above. In order to prevent this, a plurality of polishing systems, e.g., two polishing systems for rough machining and finish machining, must be conventionally provided, so that the costs increase.

In the above described conventional system, the wafer W is caused to rotate on its axis so that the whole surface of the wafer W is polished by the abrasive cloth 2 at a substantially constant peripheral velocity. The rotating velocity of the wafer W must be adjusted so that the peripheral velocity of a portion of the wafer W on the central side of the rotating table 4 is equal to the peripheral velocity of a portion of the wafer W on the peripheral side of the rotating table 4. Therefore, it is required to very strictly fine control the rotational speed of the rotating table 4 and the rotating velocity of the wafer W.

In addition, in the above described conventional system, the abrasive cloth 2 on the rotating table 4 is arranged on the lower side, and the wafer W is arranged on the upper side of the abrasive cloth 2. Therefore, there is a problem in that slurry and so forth produced by the polishing are easy to adhere to the irregularity portion of the surface of the abrasive cloth 2 to remain therein, so that it is not easy to clean the abrasive cloth 2.

Moreover, since the whole surface of the wafer W is polished while contacting a part of the surface of the abrasive cloth 2 on the rotating table 4, it is not possible to measure the thickness of the wafer W or the thickness of the polished wafer in the middle of the polishing.

SUMMARY OF THE INVENTION

It is therefore an object of the present invention to eliminate the aforementioned problems and to provide a polishing system which can be miniaturized and which can partially control the polished quantity, and a polishing method therefor.

In order to accomplish the aforementioned and other objects, according to one aspect of the present invention, a polishing system comprises: a rotating mounting table which is rotatable while holding an object to be polished; a rotating polishing plate having a smaller diameter than that of the rotating mounting table, the rotating polishing plate being provided with an abrasive layer on the surface thereof; a scanning mechanism for moving the rotating polishing plate on a surface of the object, which is held on the rotating mounting table, while pressing the abrasive layer on the object; and abrasive solution supply means for supplying an abrasive solution to the surface of the object.

Thus, the object to be polished rotates while being held on the rotating mounting table having substantially the same diameter than that of the object, and the abrasive layer of the rotating polishing plate having a smaller diameter than that of the object is rotated while being pressed on the surface of the object. The rotating polishing plate rotates on its axis while scanning, for example, in radial directions of the object by means of the scanning mechanism, so that the surface of the object is polished.

Therefore, since the rotating mounting table can have substantially the same diameter than that of the object, it is possible to remarkably decrease the size of the system. In addition, since the rotating polishing plate has a smaller diameter than that of the object, the polished quantity can be partially controlled by changing the residence time of the rotating polishing plate or the like.

In the polishing system, the diameter of the rotating polishing plate may be set to be half or less as large as the diameter of the rotating mounting table so that the partial polished quantity can be fine controlled.

In addition, the scanning mechanism may include: pressing force detecting means for detecting a pressing force which presses the abrasive layer on the object; and pressing force regulating means for regulating the pressing force on the basis of the detected value of the pressing force detecting means. Thus, the optimum pressing force for the polishing can be set, and the pressing force can be changed in the middle of the polishing if necessary.

Moreover, the abrasive solution supply means may be mounted on the scanning mechanism so that the abrasive solution can be always supplied to the position the rotating polishing plate.

In addition, the polishing system may further comprise cleaning solution supply means for supplying a cleaning solution to the surface of the object so that the polishing solution, which has been used in the last step, e.g., the rough machining step, can be quickly washed with the cleaning solution.

Moreover, the polishing system may further comprise a scruber mechanism for scrubing the object so that it is possible to continuously carry out the scrubing operation for removing the processed surface layer of the object after, e.g., the finishing machining.

According to another aspect of the present invention, a polishing system comprises: a rotating mounting table which is rotatable while holding an object to be polished; and a plurality of polishing mechanisms for polishing the object at different polishing accuracy, each of the plurality of polishing mechanisms comprising: a rotating polishing plate having a smaller diameter than that of the rotating mounting table, the rotating polishing plate being provided with an abrasive layer on the surface thereof; a scanning mechanism for moving the rotating polishing plate on a surface of the object, which is held on the rotating mounting table, while pressing the abrasive layer on the object; and abrasive solution supply means for supplying an abrasive solution to the surface of the object.

Thus, for example, the rough machining and finish machining can be continuously carried out by a single system.

This polishing system may further comprise cleaning solution supply means for supplying a cleaning solution to the surface of the object so that the polishing solution, which has been used in the last step, e.g., the rough machining step, can be quickly washed with the cleaning solution. Moreover, the polishing system may further comprise a scruber mechanism for scrubing the object so that it is possible to continuously carry out the scrubing operation for removing the processed surface layer of the object after, e.g., the finishing machining.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENTS

Referring now to the accompanying drawings, the preferred embodiments of a polishing system according to the present invention will be described below.

Figure 1:
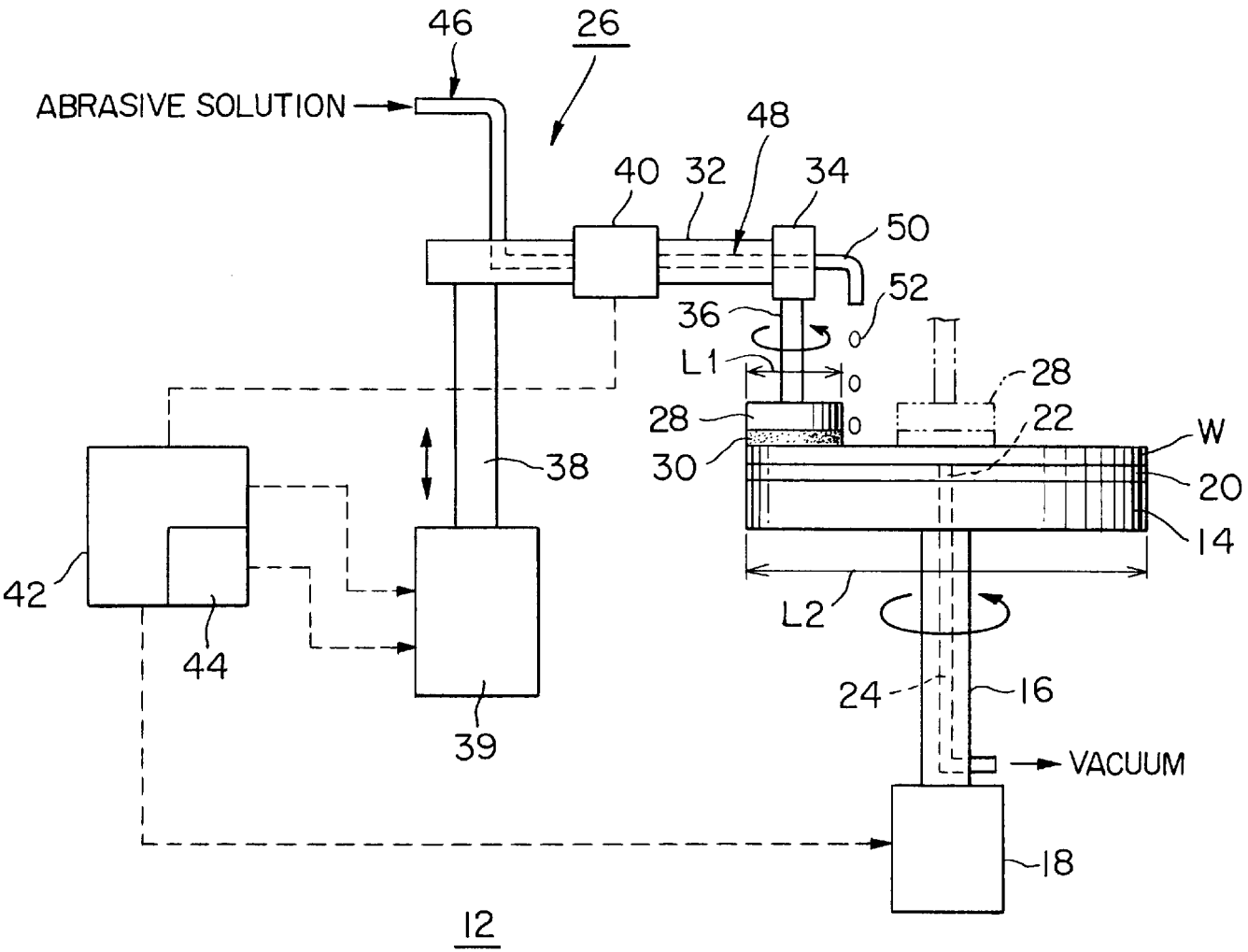
FIG. 1 is a schematic diagram showing the whole construction of a polishing system according to the present invention.
Figure 2:
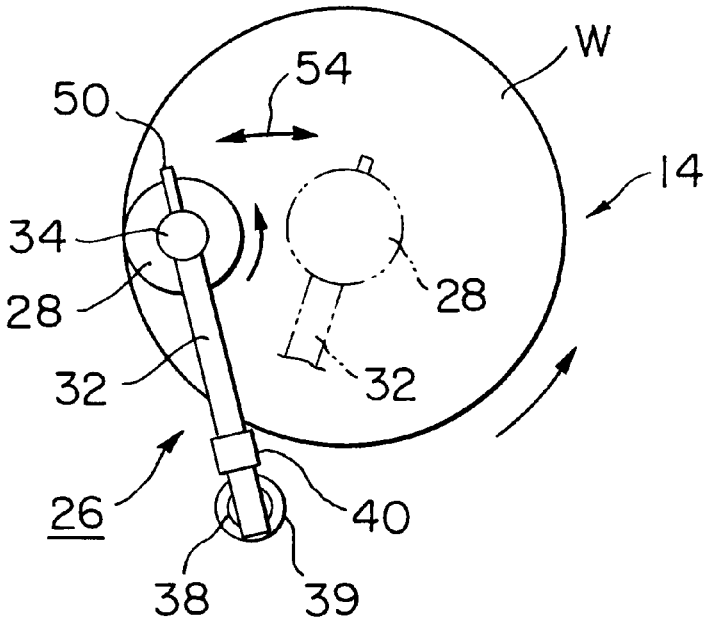
FIG. 2 is a top view of the system of FIG. 1.
Figure 3:
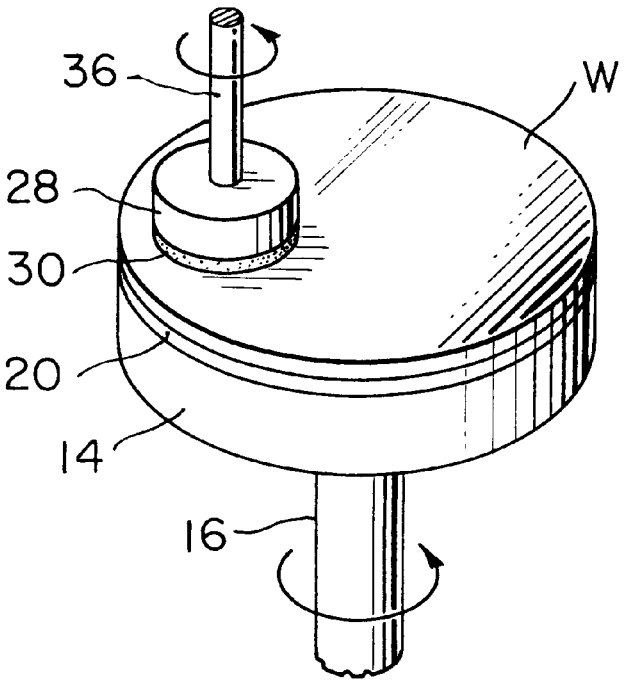
FIG. 3 is a partially perspective view of the system of FIG. 1.
Figure 4:
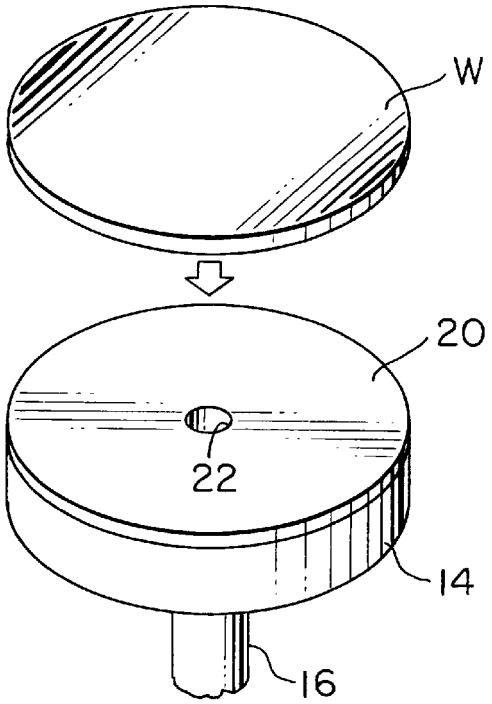
FIG. 4 is a perspective view of a rotating mounting table.

FIG. 1 is a schematic diagram showing the whole construction of a polishing system according to the present invention, and FIG. 2 is a top view of the system of FIG. 1. In addition, FIG. 3 is a partially perspective view of the system of FIG. 1, and FIG. 4 is a perspective view of a rotating mounting table.

As shown in FIG. 1, a polishing system 12 has a rotating mounting table 14 of, e.g., stainless steel. The rotating mounting table 14 is connected to a motor 18 via a rotating shaft 16, which extends downwards from the central portion, so as to be rotatable. A hard resin 20 of, e.g., teflon, is put on the upper surface of the rotating mounting table 14 so as to prevent the reverse surface of a semiconductor wafer W, which serves as an object to be polished and which is vacuum held to the upper surface of the rotating table 14, from being damaged and so as to uniformly receive the pressing force from a rotating polishing plate, which will be described later.

Figure 8:
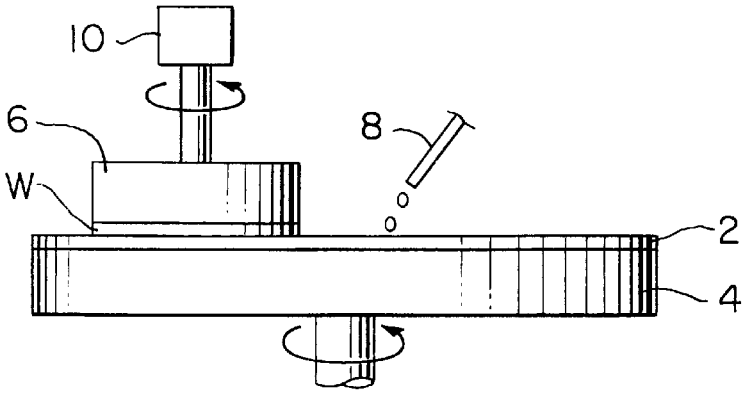
FIG. 8 is a schematic diagram of a conventional polishing system.

The diameter of the rotating mounting table 14 is set to be substantially the same as or slightly greater than the diameter of the wafer W. Unlike the conventional system shown in FIG. 8, it is not required to set the diameter of the rotating mounting table 4 to be twice or more as large as the diameter of the wafer W. For that reason, it is possible to considerably decrease the size of the rotating mounting table 14, and it is possible to polish the wafer W having a large diameter without causing any problems.

On the central portion of the upper surface of the rotating mounting table 14, a suction port 22 (see FIG. 4) is provided. The wafer W can be vacuum held to the hard resin 20 by evacuating a suction passage 24 communicated with the suction port 22.

A rotating polishing plate 28 supported on a scanning mechanism 26 is provided above the rotating mounting table 14 so as to scan in radial directions of the rotating mounting table 14.

The rotating mounting plate 28 comprises a disc of, e.g., stainless steel. The diameter L1 of the rotating mounting plate 28 is set to be less than or equal to half, preferably about a fourth, of the diameter L2 of the rotating mounting table 14.

An abrasive cloth 30 serving as an abrasive layer is stuck on the surface of the rotating polishing plate 28, i.e., the lower surface of the rotating polishing plate 28 in FIG. 1. The abrasive cloth 30 may be made of a foam resin, such as urethane foam resin, which has a thickness of, e.g., about 1.2 mm.

The wafer W is held on the hard resin 20 on the rotating mounting table 14, and the rotating polishing plate 28 and the abrasive cloth 30 are arranged above the wafer W. Therefore, slurry and so forth, which are produced by the polishing, are tend to stay on the surface of the wafer W arranged below the abrasive cloth 30, so that the abrasive cloth 30 is easily cleaned.

The rotating polishing plate 28 is connected to a rotating shaft 36 of a motor 34, which is provided at the tip of a pivotable arm 32 serving as a part of the scanning mechanism 26, to be rotatable at a high speed. The base end portion of the pivotable arm 32 is connected to a pivotable lifting shaft 38. The pivotable lifting shaft 38 is connected to a pivotable lifting drive unit 39 for hydraulically or pneumatically moving the pivotable lifting shaft 38 in vertical directions or for rotating the pivotable lifting shaft 38.

In the middle of the pivotable arm 32, a load cell 40 serving as pressing force detecting means is provided for detecting a load applied to the pivotable arm 32, i.e., a pressing force of the rotating polishing plate 28 on the surface of the wafer. The output of the load cell 40 is inputted to a control part 42 of, e.g., a microcomputer. The control part 42 includes pressing force regulating means 44 for carrying out predetermined calculations so that the detected pressing force is a desired pressing force. The output of the pressing force regulating means 44 is inputted to the pivotable lifting drive unit 39.

The control part 42 also controls the motors 18 and 34 and the rotation of the pivotable lifting shaft 38.

By calculating the lifted quantity from the original position of the pivotable lifting shaft 38, the polished thickness of the wafer W can be recognized. By detecting the thickness of the wafer W at a portion of the wafer W which is not covered by the rotating polishing plate 28, the thickness of the polished wafer W or the polished quantity can be recognized even during the polishing.

The pivotable arm 32 can pivot in various directions in a plane parallel to the surface of the wafer W. By the pivotal movement of the pivotable arm 32, the rotating polishing plate 28 and the abrasive cloth 30 scan on the surface of the wafer W everywhere. For example, the rotating polishing plate 28 and the abrasive cloth 30 can scan in a radial direction from the periphery of the wafer W toward the center of the wafer W. In this case, in order to uniformly polish the whole surface of the wafer W, the scanning speeds of the rotating polishing plate 28 and the abrasive cloth 30 from the periphery of the wafer W toward the center of the wafer W are decreased. Furthermore, when the rotating polishing plate 28 and the abrasive cloth 30 scan from the periphery of the wafer W toward the center of the wafer W, the rotating polishing plate 28 and the abrasive cloth 30 do not need to strictly scan in radial directions as long as any region of the rotating polishing plate 28 and the abrasive cloth 30 paths over the center of the wafer W. In addition, the scanning mechanism 26 may cause the rotating polishing plate 28 and the abrasive cloth 30 to scan on the surface of the wafer everywhere, so that the movements of the rotating polishing plate 28 and the abrasive cloth 30 are not limited to straight movements, but the movements of the rotating polishing plate 28 and the abrasive cloth 30 may be other movement forms, such as spiral movements.

The pivotable arm 32 is also provided with abrasive solution supply means 46 for supplying an abrasive solution. Specifically, the abrasive solution supply means 46 has an abrasive solution supply pipe 48 extending along the pivotable arm 32, and an abrasive solution nozzle 50 provided at the tip of the abrasive solution supply pipe 48 is directed downwards from the tip of the pivotable aim 32 so that a flow controlled abrasive solution 52 can be supplied to the wafer W. This abrasive solution 52 may use particles of $SiO_2$, $CeO_2$, $Al_2O_3$ or the like as mechanical polishing particles, and particles of a fluorine compound or a chelate compound as chemical polishing particles. In particular, $CeO_2$ particles providing a great chipped quantity are preferably used for carrying out rough machining, and $SiO_2$ particles, which are difficult to damage the wafer W, are preferably used for carrying out finish machining.

Furthermore, the shown scanning mechanism is merely an example. A horizontal bar may be provided above the rotating mounting table without the need of the above described pivotable arm 32, and the rotating polishing plate 28 may be moved along the horizontal bar to scan.

With this construction, the operation of the system of the present invention will be described below.

First, the semiconductor wafer W is put on the rotating mounting table 14 while the polished surface thereof is turned up, and the suction passage 24 is evacuated to cause the wafer W to be vacuum held. In this state, the turned-up rotating polishing plate 28 is rotated at a predetermined speed of rotation while the rotating mounting table 14 is rotated at a predetermined speed of rotation, and the abrasive cloth 30 is pressed on the upper surface of the wafer W serving as a polished surface at a predetermined pressure to polish the surface. At this time, a predetermined abrasive solution 52 is added dropwise to the surface of the wafer from the abrasive solution nozzle 50 of the abrasive solution supply means 46 at a controlled flow rate.

Thus, while the wafer W rotates on its axis, the rotating polishing plate 28 also rotates on the upper surface of the wafer W on its axis. In addition, the scanning mechanism 26 is driven to cause the pivotable arm 32 to pivot as shown by arrow 54 in FIG. 2, so that the rotating polishing plate 28 reciprocates in radial directions of the wafer W to polish the whole surface of the wafer W. At this time, the rotational speeds of the rotating mounting table 14 and the rotating polishing plate 28 are in the range of, e.g., from about 50 to about 500 rpm, respectively, although the rotational speeds depend on the processing conditions.

The pressing force of the rotating polishing plate 28 applied to the surface of the wafer W is detected by the load cell 40 serving as pressing force detecting means. The detected value is transmitted to the pressure regulating means 44 to be compared with a preset reference value. The pivotable lifting drive unit 38 is controlled so as to maintain the reference value, so that the vertical movement of the pivotable arm 32 is fine controlled. At this time, the pressing force is in the range of from about 0.2 $kg/cm^2$ to about 2 $kg/cm^2$ although it depends on the polishing rate. In particular, the pressing force is about 0.3 $kg/cm^2$ in the case of finish machining, and about 500 $g/cm^2$ in the case of rough machining.

Comparing the quantity of abrasive solution 52 used in this preferred embodiment with that in a conventional system to chip the same thickness of 1 $\mu m$ in the same polishing time, e.g., 4 to 5 minutes, about 800 cc of abrasive solution was required by the conventional system, whereas only about 200 cc of abrasive solution was required in this preferred embodiment, so that the quantity of the abrasive solution to be used can be decreased to about a fourth.

In this preferred embodiment, the pressing force can be partially changed by the pressing force regulating means 44, and the oscillating speed of the pivotable arm 32 can be changed or the pivotable arm 32 can be stopped. Therefore, it is not possible only to partially control the pressing force in accordance with the distortion or deformation of the wafer, but it is also possible to control the residence time of the rotating polishing plate 28, so that it is possible to partially fine control the polished quantity. Therefore, it is possible to accurately and uniformly machine the surface of the wafer to improve flatness.

Thus, in this preferred embodiment, the diameter of the rotating mounting table 14 may be substantially the same as that of the wafer W unlike the conventional systems, so that it is possible to remarkably decrease the size of the system.

Furthermore, after the polishing treatment is completed, the pivotable arm 32 is moved upwards to cause the abrasive cloth 30 to be apart from the surface of the wafer W, and the pivotable arm 32 is oscillated to be moved to the outside from a portion above the wafer W.

A modified embodiment of a polishing system according to the present invention will be described below.

Figure 5:
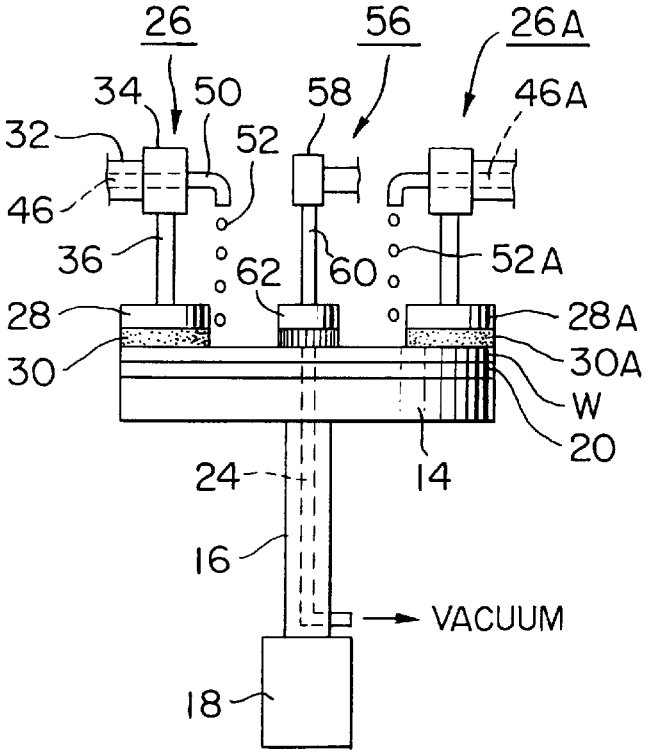
FIG. 5 is a schematic diagram of a principal part of a modified embodiment of a polishing system according to the present invention.
Figure 6:
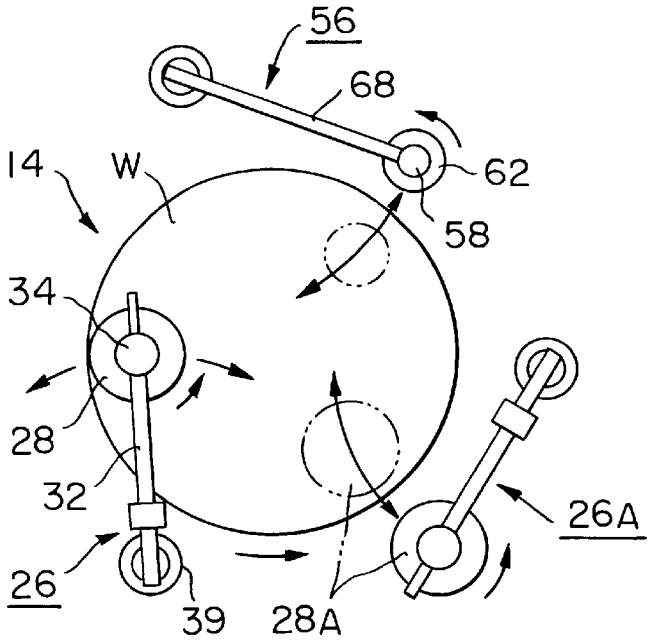
FIG. 6 is a schematic plan view of the system of FIG. 5.
Figure 7:
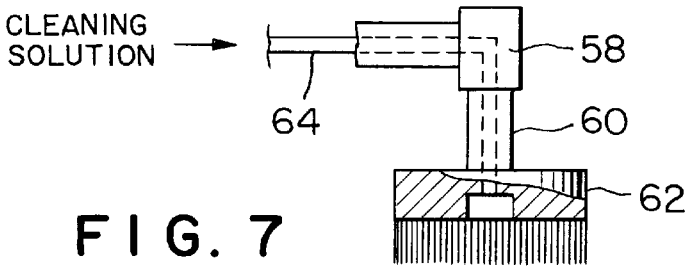
FIG. 7 is a partially sectional view of a principal part of a scruber mechanism.

In the above described preferred embodiment, a set of rotating polishing plate 28, scanning mechanism 26 and abrasive solution supply means 46 has been provided. In this modified embodiment, a plural sets, e.g., two sets, of rotating polishing plates, scanning mechanisms and abrasive solution supply means are provided, and a scruber mechanism is also provided. FIG. 5 is a schematic diagram of a principal part of the modified embodiment of a polishing system according to the present invention, FIG. 6 is a schematic plan view of the system of FIG. 5, and FIG. 7 is a partially sectional view of a principal part of a scruber mechanism. Futhermore, the same reference numbers are used for the same elements as those in the above described preferred embodiment, and the descriptions thereof are omitted.

In this embodiment, a second polishing plate 28A, a second scanning mechanism 26A and second abrasive solution supply means 46A are provided on the periphery of the rotating mounting table 14 in addition to the rotating polishing plate 28, the scanning mechanism 26 and the abrasive solution supply means 46 which have been described above. A scruber mechanism 56 is also provided on the periphery of the rotating mounting table 14.

Specifically, the rotating polishing plate 28, the scanning mechanism 26 and the abrasive solution supply means 46 are used for carrying out, e.g., rough machining, and the second polishing plate 28A, the second scanning mechanism 26A and the second abrasive solution supply means 46A are used for carrying out, e.g., finish machining. Therefore, although the basic constructions of both sets are the same, abrasive solutions 52 and 52A supplied from the abrasive solution supply means 46 and 46A are different from each other. For example, the abrasive solution 52 for rough machining includes $CeO_2$ particles, and the abrasive solution 52A for finish machining includes $SiO_2$ particles.

Also as shown in FIG. 7, the scruber mechanism 56 has a rotating brush connected to a rotating shaft 60 of a motor 58. In the scruber mechanism 56, a cleaning solution passage 64 serving as cleaning solution supply means for supplying a cleaning solution to the surface of the wafer is provided. The cleaning solution may be pure water, or pure water containing about 0.5% of hydrofluoric acid or aqueous ammonia. Furthermore, the cleaning solution supply means 64 may be separately and fixedly provided above the center of the rotating mounting table 14.

The motor 58 is provided at the tip of a scruber pivotable arm 68. This pivotable arm 68 is connected to a scruber pivotable lifting drive unit 72 via a scruber pivotable lifting shaft 70 to be movable vertically and oscillatable in radial directions of the wafer W.

The operation of this modified embodiment will be described below.

As described in the above preferred embodiment, the rough machining of the surface of the wafer W is carried out by means of the rotating polishing plate 28, the scanning mechanism 26 and the abrasive solution supply means 46. In this case, the abrasive solution 52 is an abrasive solution for rough machining so as to increase the chipped quantity, and the pressing force is set to be a high value, e.g., about 1 $kg/cm^2$, to increase the chipped quantity per unit time.

Thus, after the rough machining for a predetermined period of time is completed, the rotating polishing plate 28 is retracted toward the periphery of the wafer W from the portion above the wafer W, and the retracted scruber mechanism 56 is driven to cause the rotating brush 62 to contact the upper surface of the wafer W. While the rotating brush 62 is rotated, a predetermined cleaning solution is supplied to the surface of the wafer from the cleaning solution supply passage 64 to scrube the surface of the wafer to wash the residual abrasive solution for rough machining. At this time, the rotating mounting table 14 is also rotated. In this case, since the area of the rotating mounting table 14 is slightly smaller than that of the conventional system, it is possible to quickly the abrasive solution for rough machining, which is adhered to the rotating mounting table 14, in a short time, so that throughput is hardly deteriorated.

Thus, after the cleaning is completed, the scruber pivotable arm 68 is revolved to cause the rotating brush 62 to be retracted from the upper surface of the wafer W toward the periphery thereof. Then, the second scanning mechanism 26A for finish machining is driven to press the second rotating polishing plate 28A on the surface of the wafer W. Then, while rotating the second rotating polishing plate 28A, the abrasive solution 52A for finishing machining is added dropwise to the wafer by the second abrasive solution supply means 46A to carry out finish polishing. At this time, the pressing force is set to be a smaller value than that during the rough machining, e.g., about 0.3 kmf/cm$^2$.

Thus, after the finish machining is carried out for a predetermined period of time, the second rotating polishing plate 28A is retracted from the upper surface of the wafer W toward the periphery thereof. Then, as described above, the scruber mechanism 56 is driven to cause the rotating brush 62 to contact the upper surface of the wafer W. Then, while rotating the rotating brush 62, a predetermined cleaning solution is supplied to the surface of the wafer from the cleaning solution supply passage 64 to scrube the surface of the wafer to wash the abrasive solution for finish machining.

Thus, after the scrubing is completed, the rotating brush 62 is retracted from the surface of the wafer toward the periphery thereof. Then, the rotating mounting table 14 is rotated at a high speed to drain the cleaning solution adhered to the wafer W, and spin dry is carried out to complete treatment.

Thus, according to this modified embodiment, a plurality of polishing steps, e.g., a rough machining step and a finish machining step, can be carried out by a single polishing system. In addition, since the size of the rotating mounting table 14 for holding the wafer W is small, it is possible to quickly wash the abrasive solution for the last step, which remains on the upper surface of the rotating mounting table 14, in a short time, so that throughput is hardly deteriorated.

While two steps for rough machining and finish machining have been carried out by a single system, the number of steps carried out by a single system can be further increased by providing an additional rotating polishing plate.

In the above described preferred embodiment, while the two polishing steps for rough machining and finish machining and the scrubing step have been carried out by the common rotating mounting table 14, only two polishing steps may be carried out by a common rotating mounting table 14, or a polishing step and a scrubing step may be carried out by a common rotating mounting table 14.

Furthermore, since the numerical values described in the above preferred embodiments are only examples, the numerical values may be changed in accordance with processing conditions so as to carry out the process on the optimum conditions.

While the object to be polished has been the semiconductor wafer, the present invention should not be limited thereto, but it may be applied to a glass substrate, an LCD substrate or the like.

As described above, according to the system and method of the present invention, the undermentioned excellent advantageous effects can be obtained.

While the rotating mounting table for holding the object to be polished is caused to rotate on its axis, the abrasive layer of the rotating polishing plate having a smaller than the rotating mounting table is pressed on the object to be polished. In addition, while the rotating polishing plate is rotated, the object is polished. Therefore, the size of the system itself can be remarkably decreased.

In addition, since the rotating polishing plate has a smaller diameter than that of the rotating mounting table, the rotating polishing plate can hold an object to be polished, which has a greater diameter than that of the rotating mounting plate, so that it is possible to easily polish the wafer W having a very large diameter.

In addition, since the area of the rotating polishing plate is small, the quantity of the used abrasive solution can be reduced.

Moreover, since the pressing force detecting means for detecting the pressing force is provided and the values thereof can be controlled to partially change the pressing force, it is possible to fine control the pressing force in accordance with the distortion or deformation of the object to be polished, to adjust the polished quantity, so that it is possible to improve the flatness of the object in plane.

In addition, it is possible to accurately the cleaning solution to the polishing position by providing the cleaning solution supply means in the scanning mechanism.

Moreover, by providing a plurality of rotating polishing plates having different polishing accuracy and a scruber mechanism, it is possible to carry out a plurality of polishing steps by a single system without substantially decreasing throughput, so that it is possible to remarkably decrease the costs.

In addition, since the rotating mounting table holds thereon the wafer W and the rotating polishing plate is arranged above the wafer W, the slurry and so forth produced by the polishing are difficult to remain, so that it is possible to easily clean the abrasive layer and so forth.

In addition, since the rotating polishing plate has a smaller diameter than that of the rotating mounting table and the rotating polishing plate does not contact the whole surface of the object to be polished, it is possible to measure the thickness of the object to be polished, the polished thickness and so forth in the middle of the polishing.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A polishing system comprising:

a rotating mounting table which is rotatable while holding an object to be polished;

a rotating polishing plate having a smaller diameter than that of said rotating mounting table, said rotating polishing plate being provided with an abrasive layer on the surface thereof;

a scanning mechanism for moving said rotating polishing plate on a surface of said object, which is held on said rotating mounting table, while pressing said abrasive layer on said object, said scanning mechanism moving said rotating polishing plate on the surface of said object at varying speeds so that the entire surface of said object is uniformly polished; and abrasive solution supply means for supplying an abrasive solution to the surface of said object.

2. A polishing system as set forth in claim 1, wherein said diameter of said rotating polishing plate is set to be half or less as large as the diameter of said rotating mounting table.

3. A polishing system as set forth in claim 1, wherein said scanning mechanism includes:

pressing force detecting means for detecting a pressing force which presses said abrasive layer on said object; and pressing force regulating means for regulating said pressing force on the basis of a detected value of said pressing force detecting means.

4. A polishing system as set forth in claim 1, wherein said abrasive solution supply means is mounted on said scanning mechanism.

5. A polishing system as set forth in claim 1, which further comprises cleaning solution supply means for supplying a cleaning solution to the surface of said object.

6. A polishing system as set forth in claim 1, which further comprises a scruber mechanism for scrubing said object.

7. A polishing system as set forth in claim 1, wherein said rotating mounting table holds thereon said object, and said rotating polishing plate is arranged above said object.

8. A polishing system as set forth in claim 1 wherein said scanning mechanism moves said rotating polishing plate on the surface of said object in a radial direction between a periphery of said object and a center of said object, and said varying speeds of said rotating polishing plate decrease from the periphery of said object toward the center of said object.

9. A polishing system comprising:

a rotating mounting table which is rotatable while holding an object to be polished; and a plurality of polishing mechanisms for polishing said object at different polishing accuracy, each of said plurality of polishing mechanisms comprising:

a rotating polishing plate having a smaller diameter than that of said rotating mounting table, said rotating polishing plate being provided with an abrasive layer on the surface thereof;

a scanning mechanism for moving said rotating polishing plate on a surface of said object, which is held on said rotating mounting table, while pressing said abrasive layer on said object, said scanning mechanism moving said rotating polishing plate on the surface of said object at varying speeds so that the entire surface of said object is uniformly polished; and abrasive solution supply means for supplying an abrasive solution to the surface of said object.

10. A polishing system as set forth in claim 9, wherein said diameter of said rotating polishing plate of each of said polishing mechanisms is set to be half or less as large as the diameter of said rotating mounting table.

11. A polishing system as set forth in claim 9, wherein said scanning mechanism of each of said polishing mechanisms includes:

pressing force detecting means for detecting a pressing force which presses said abrasive layer on said object; and pressing force regulating means for regulating said pressing force on the basis of a detected value of said pressing force detecting means.

12. A polishing system as set forth in claim 9, wherein said abrasive solution supply means of each of said polishing mechanisms is mounted on said scanning mechanism.

13. A polishing system as set forth in claim 9, which further comprises cleaning solution supply means for supplying a cleaning solution to the surface of said object.

14. A polishing system as set forth in claim 9, which further comprises a scruber mechanism for scrubing said object.

15. A polishing system as set forth in claim 9 wherein said scanning mechanism moves said rotating polishing plate on the surface of said object in a radial direction between a periphery of said object and a center of said object, and said varying speeds of said rotating polishing plate decrease from the periphery of said object toward the center of said object.

16. A polishing method comprising the steps of:

rotating a rotating mounting table while holding an object to be polished, on said rotating mounting table;

supplying an abrasive solution to a surface of said object by abrasive solution supply means;

moving a rotating polishing plate, which has a smaller diameter than that of said rotating mounting table, along the surface of said object held on said rotating mounting table, while pressing an abrasive layer, which is provided on a surface of said rotating polishing plate, on said object by means of a scanning mechanism, said scanning mechanism moving said rotating polishing plate on the surface of said object at varying speeds so that the entire surface of said object is uniformly polished; and polishing the surface of said object.

17. A polishing method as set forth in claim 16 wherein said scanning mechanism moves said rotating polishing plate on the surface of said object in a radial direction between a periphery of said object and a center of said object, and said varying speeds of said rotating polishing plate decrease from the periphery of said object toward the center of said object.

18. A polishing method comprising the steps of:

rotating a rotating mounting table while holding an object to be polished, on said rotating mounting table; and sequentially driving a plurality of polishing mechanisms at different polishing accuracy in a predetermined order to polish a surface of said object, wherein each of said plurality of polishing mechanisms comprising:

a rotating polishing plate having a smaller diameter than that of said rotating mounting table, said rotating polishing plate being provided with an abrasive layer on the surface thereof;

a scanning mechanism for moving said rotating polishing plate on the surface of said object, which is held on said rotating mounting table, while pressing said abrasive layer on said object, said scanning mechanism moving said rotating polishing plate on the surface of said object at varying speeds so that the entire surface of said object is uniformly polished; and abrasive solution supply means for supplying an abrasive solution to the surface of said object.

19. A polishing method as set forth in claim 18 wherein said scanning mechanism moves said rotating polishing plate on the surface of said object in a radial direction between a periphery of said object and a center of said object, and said varying speeds of said rotating polishing plate decrease from the periphery of said object toward the center of said object.

* * * * *